US006348111B1

(12) United States Patent
Yuki et al.

(10) Patent No.: US 6,348,111 B1
(45) Date of Patent: Feb. 19, 2002

(54) METHOD FOR PRODUCING FE—NI ALLOY

(75) Inventors: Norio Yuki; Yoshihisa Kita, both of Kanagawa (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/260,514

(22) Filed: Mar. 2, 1999

(30) Foreign Application Priority Data

Mar. 19, 1998 (JP) ..... 10-90962

(51) Int. Cl.[7] ..... C21D 8/12

(52) U.S. Cl. ..... 148/546; 148/556; 148/621; 148/676

(58) Field of Search ..... 148/546, 556, 148/336, 621, 676

(56) References Cited

U.S. PATENT DOCUMENTS 4,698,545 A * 10/1987 Inaba et al. ..... 313/402
5,102,477 A * 4/1992 Iwayama et al. ..... 148/100
5,234,513 A * 8/1993 Inoue et al. ..... 148/541
5,264,050 A * 11/1993 Nakashima et al. ..... 148/336
5,891,271 A * 4/1999 Yuki et al. ..... 148/331
5,916,380 A * 6/1999 Yuki et al. ..... 149/336
5,962,965 A * 10/1999 Yuki et al. ..... 313/441

FOREIGN PATENT DOCUMENTS

JP 50014531 * 2/1975

* cited by examiner

*Primary Examiner*—Roy King
*Assistant Examiner*—Harry D. Wilkins, III
(74) *Attorney, Agent, or Firm*—Birch, Stewart, Kolasch & Birch, LLP

(57) ABSTRACT

Fe—Ni alloy sheet having improved press-punching formability is produced by specifying the sulfide-forming elements [X%] and sulfur [%S] and by heating, prior to hot-working, to a temperature dependent upon the contents of these elements. The Fe—Ni alloy contains from 30 to 55% of Ni, not more than 0.8% of Mn, from 0.001 to 0.050% of S, from 0.005 to less than 0.5% of Ti, Mg, Ce and/or Ca, the balance being Fe and unavoidable impurities, and in which the product of the total content of the Ti, Mg, Ce and Ca and the total content of S ([%X]×[%S]) is limited to a range of from 0.00005 to 0.010. The heating temperature (T) is:

$$1050^\circ\ C. \leqq T(^\circ C.) \leqq \{19500/[8.5-\log[\%X][\%S]]\}-350.$$

7 Claims, 3 Drawing Sheets

T=19500/(8.5−log[%X][%S])−350
T(°C)
1400
1300
1200
1100
1000
900
10^−5
10^−4
10^−3
10^−2
[%X][%S]

METHOD FOR PRODUCING FE— NI ALLOY

BACKGROUND OF INVENTION

1. Field of Invention

The present invention relates to a method for producing an Fe—Ni alloy with improved punching property, which is suited for the electrode material of an electron-gun.

2. Description of Related Art

FIG. 1 is a cross-sectional view of the known shadow-mask type color cathode-ray tube. A fluorescent coating 2 is applied on the panel 1 and emits three primary colors, i.e., red, green and blue. An electron-gun 4 is provided in the neck of the cathode-ray tube and emits electron beams 3. The electron beams 3 are deflected and scanned by the deflecting yoke 5. Reference numerals 6 and 7 denote the shadow mask and the magnetic shield, respectively. All of these parts 1 through 7 are known.

FIGS. 2(A) and (B) are the illustrative view and cross-sectional view of an electrode (grid electrode) of the electron gun 4, respectively. The minute apertures 10*a,* 10*b* and 10*c* are formed by coining and punching a sheet and let the respective electron beam pass therethrough for generating the colors red (10*a*), green (10*b*) and blue (10*c*). For the parts of an electron-gun used in a color cathode-ray tube, a non-magnetic stainless steel sheet having a thickness of from 0.05 to 0.5 mm has conventionally been used, since the non-magnetic property is important for the electrodes 10 which accelerate the electrons emitted from the cathode of the electron gun. Such a sheet is intermediately coined and then blank-worked as above or is directly blanked without coining.

Recently, rather than the non-magnetic property, a low thermal expansion property is considered to be more important, because the color cathode-ray tube of a computer-display or the like has become highly precise and its performance is enhanced. In this case, picture performance (purity of color) is influenced by subtle dimensional changes in the electrode 10 due to its thermal expansion.

Since an Fe—Ni alloy, particularly Fe—42% Ni alloy (the so-called 42 Alloy), has a low thermal expansion property, its use as the electrode material has now been undertaken. However, when the conventional 42 Alloy is punched by means of a punch to form the minute apertures 10*a,* 10*b* and 10*c,* burrs are detrimentally formed at the front end 10*e* (FIG. 2(B)), where the punching tailings are separated from the sheet. The punching burrs exert a detrimental effect upon the dimensional accuracy of the electron-gun part which is required to be highly precise. Minimizing of the burrs of an electrode-gun part will be more and more highly demanded along with precision of the color cathode-ray tube.

There are, heretofore, proposals in Japanese Unexamined Patent Publications Nos. 6-122,945, 6-184,703, 7-3,400 and 7-34,199 to improve the press-punching formability of an Fe—Ni alloy. In Japanese Unexamined Patent Publication No. 6-184,703, the S content of an Fe—Ni alloy is limited to a range of 0.002 to 0.05%, and the sulfur or sulfur compound is dispersed along the grain boundaries or within the crystal grains. However, the burrs cannot be satisfactorily prevented only by means of adding a specified amount of sulfur; hence, efforts to improve the machinability, when the alloy is subjected to the extremely precise press forming, have been carried out in recent years.

Next, the proposals made in Japanese Unexamined Patent Publications Nos. 6-122,945, 7-3,400and 7-34,199, reside in that such strengthening elements as Ti, Nb, V, Ta, W, Zr and the like are added to enhance the hardness and hence to induce a degree of brittleness thereby suppressing the burrs. The life of a metal die is, however, shortened due to the increased hardness of the Fe—Ni alloy.

SUMMARY OF THE INVENTION

It is an object of the present invention to eliminate the above described drawbacks and to provide a method for producing an Fe—Ni alloy, the press-punching formability of which required for the press-formed part of an electron gun is improved.

The present inventors considered various ways to find a relationship between the press-punching formability and inclusions and a relationship between the distribution of inclusions and the production conditions.

As a result, it was discovered that the press-punching formability is improved by means of limiting the Ti, Mg, Ce, Ca and S contents in a specified range and hot-working in an appropriate range of temperature which is dependent upon the above contents. More specifically, an appropriate amount of Ti, Mg, Ce and Ca sulfides formed in the Fe—Ni alloy can promote propagation of cracks generated during the press-punching, thereby improving the press-punching formability. The heating temperature at the hot-working exerts great influence upon the amount and distribution of the sulfides which are important for improving the press-punching formability, particularly for suppressing the burrs.

Furthermore, Ti, Mg, Ce and Ca are mainly combined with sulfur to improve the press-punching formability but are not dissolved in the matrix of the alloy appreciably. These elements do not, therefore, result in the hardness increase and hence shortening of the life of a metal die.

The method according to the present invention is based on the above discoveries and comprises the steps of:

melting an Fe—Ni alloy, which contains, by weight percentage, from 30 to 55% of Ni, not more than 0.8% of Mn, from 0.001 to 0.050% of S, from 0.005 to less than 0.5% of at least one element selected from the group consisting of Ti, Mg, Ce and Ca, the balance being Fe and unavoidable impurities, and in which the product of the total content of said Ti, Mg, Ce and Ca and the content of S is limited in a range of from 0.00005 to 0.0100;

casting the melted alloy;

heating the alloy prior to hot-working at a temperature (T) under the following equation, $$1050 \leqq T(^\circ\mathrm{C.}) \leqq \{19500/[8.5-\log[\%X][\%S]]\}-350,$$

in which the S content is denoted by [%S], the content of the total amount of Ti, Mg, Ce and Ca is denoted by [%X], hot-working the heated Fe—Ni alloy;

cold-rolling; and, annealing.

BRIEF DESCRIPTION OF DRAWINGS

FIGS. 2(A) and (B) are the elevational view and the cross-sectional view, respectively.

DESCRIPTION OF PREFERRED EMBODIMENTS

Figure 1:
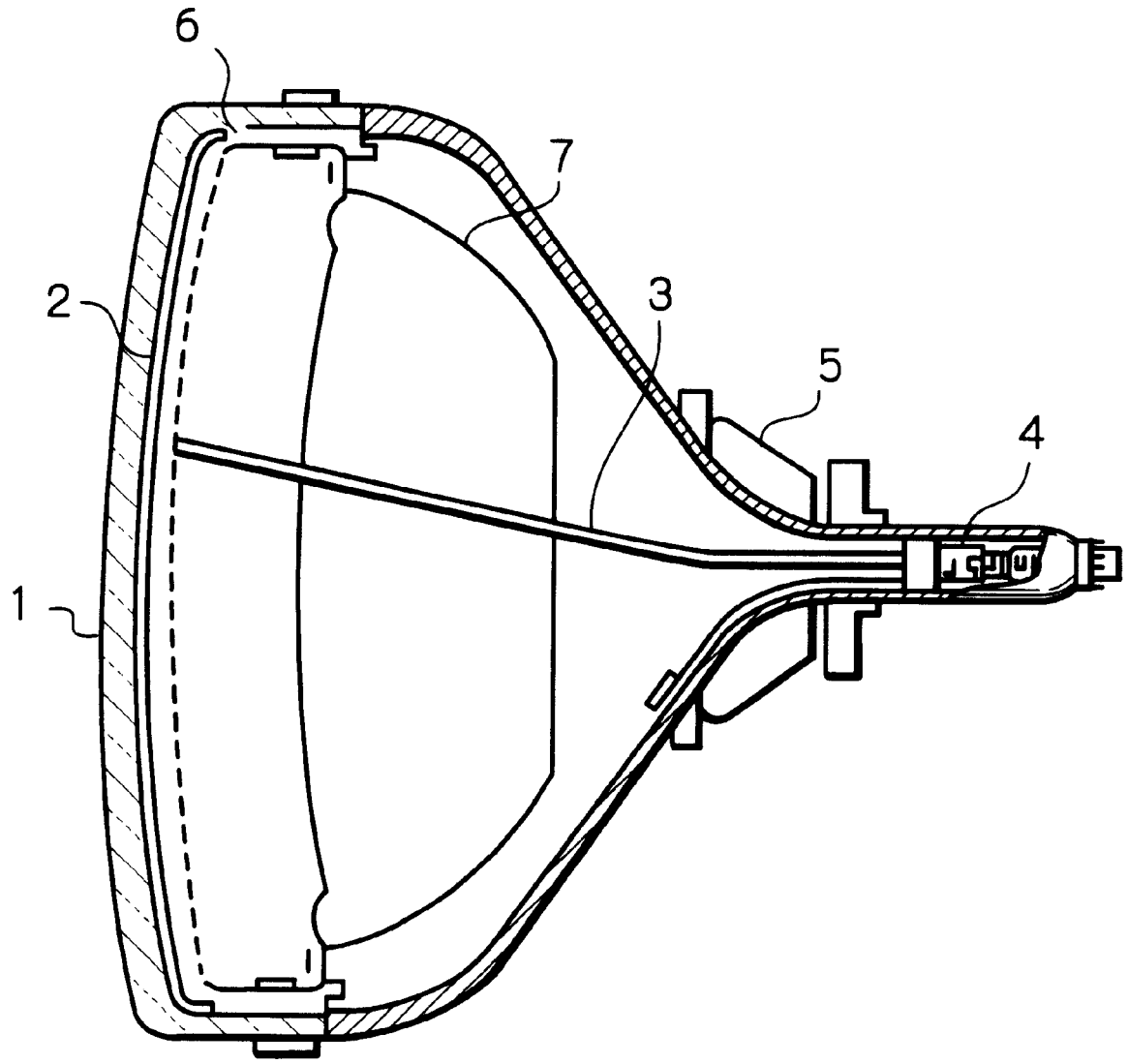
Fig. 1 PRIOR ART
FIG. 1 is a cross sectional view of a shadow-mask type cathode-ray tube.
Figure 2A:
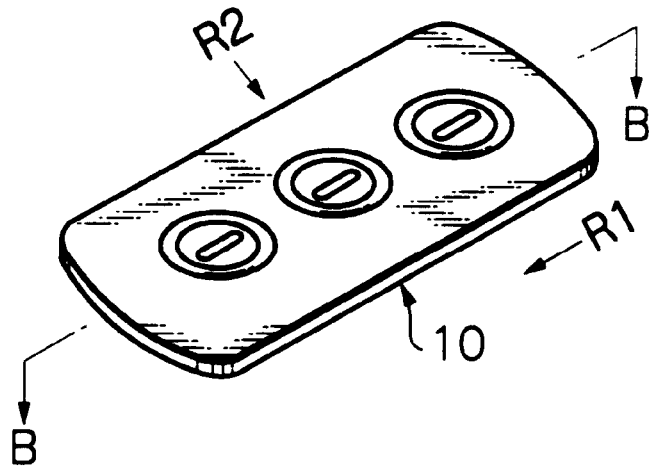
Fig. 2(A) PRIOR ART
FIGS. 2(A) and (B) show an example of the parts of an electron gun, produced by the Fe—Ni alloy according to the present invention, particularly the electrode of the electron-gun.
Figure 2B:
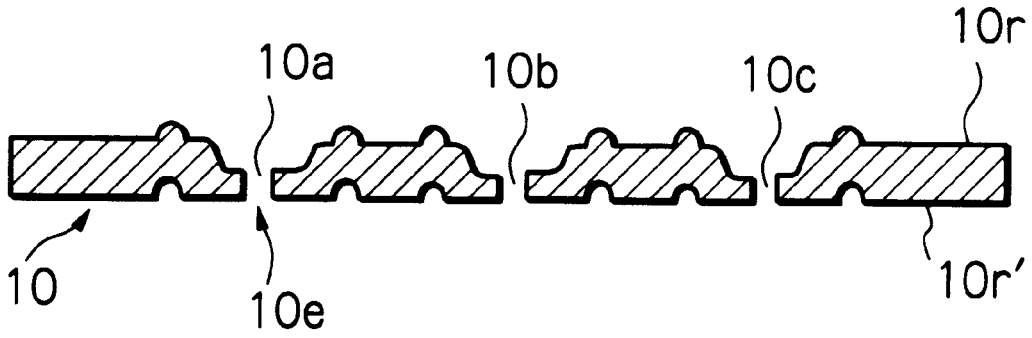

The composition of Fe—Ni alloy according to the present invention is now described.

Ni: Ni is an important element for determining the thermal expansion property of the Fe—Ni alloy. The thermal expansion is disadvantageously high, when the Ni content is less than 30% or more than 55%. The Ni content is, therefore, from 30 to 55%.

Mn: Mn is an element for improving the hot-workability. When the Mn content is more than 0.8%, the alloy is so hard that the wear of a metal die is aggravated, and further the thermal expansion becomes disadvantageously great. The Mn content is, therefore, set to 0.8% or more.

S: Sulfur is combined with Ti, Mg, Ce and Ca and forms sulfides which can improve the press-punching formability. When the S content is less than 0.001%, the press-punching formability is not satisfactorily improved. On the other hand, when the S content is more than 0.050%, the hot-workability and corrosion resistance of the Fe—Ni alloy are impaired. The S content is, therefore, set from 0.001 to 0.050%. More preferably, the S content is from 0.003 to 0.020%.

Ti, Mg, Ce and Ca: These elements form the sulfides, i.e., TiS, MgS, CeS and CaS, respectively, and hence improve the press-punching formability. When the total of these elements is less than 0.001%, the press-punching formability is not improved appreciably. On the other hand, when the total of these elements is 0.5% or more, the hardness of the alloy increases disadvantageously. The content of these elements is, therefore, from 0.001 to less than 0.5%.

The elements other than the above mentioned are Fe and unavoidable impurities, such as C, Si, Al, P and Cr. These are the usual impurities of iron and nickel and are detrimental to the thermal expanding properties. The impurities are, therefore, desirably from 0.001 to 0.5% in total.

The product of the content (wt %) of the sulfide forming elements [%X] and the content (wt %) of sulfur [%S], i.e., [%X][%S], is a factor, to which the present inventors originally paid attention for improving the press-punching formability of an Fe—Ni alloy in manufacturing the parts of an electron gun. In the present invention, the amount of sulfides is determined by the contents of sulfur and sulfide-forming elements as well as the above mentioned product [%X][%S]. When the product [%X][%S] is less than 0.00005, the amount of sulfides formed is not satisfactory for improving the press-punching formability. On the other hand, when the product [%X][%S] is more than 0.01, the amount of sulfide formed is so great that the corrosion resistance is impaired. Accordingly, $$0.00005 \leqq [\%X][\%S] \leqq 0.01$$

Heating temperature (T) of hot-working: When the heating temperature of hot-working is very low, the size of sulfide precipitated remains too small to improve the press-punching formability. It is necessary to heat a cast slab or ingot to temperature of at least 1050° C. so as to maintain an appropriate size of the sulfides and hence improves the press-punching formability. When the heating temperature (T) is very high, the sulfides are decomposed and the decomposed sulfur and sulfide-forming elements are considerably dissolved into the matrix of an Fe—Ni alloy.

Figure 3:
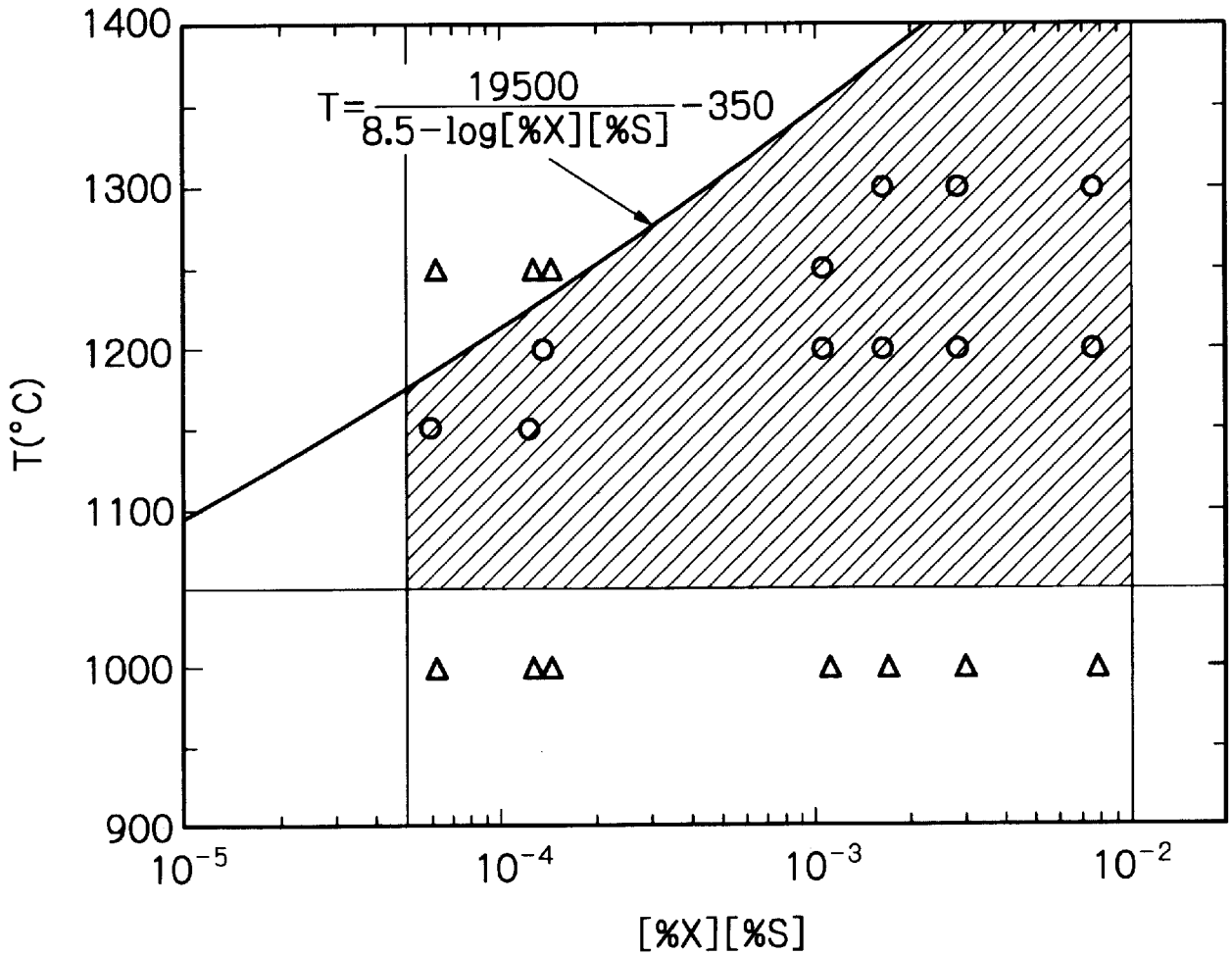
FIG. 3 is a graph illustrating a relationship between the heating temperature of hot-rolling and the concentration product [%S][%X], i.e., the concentration of the sulfur and the sulfide-forming elements.

The appropriate heating temperature for improving the press-punching formability is dependent upon the contents of sulfur and sulfide-forming elements. Referring to FIG. 3, the above described limitations, i.e., $0.00005 \leqq [\%X][\%S] \leqq 0.01$, and T=1050° C., are shown. In addition, a linear relationship between the product [%X][%S] and heating temperature (T), which distinguishes good press-punching formability (○) and failed press-punching formability (Δ), was discovered. This relationship can be expressed by the following formula.

$$T(^\circ\,\mathrm{C.}) \leqq \{19500/[8.5-\log[\%X][\%S]]\}-350$$

The process steps other than the heating for hot-rolling are now described.

In the casting step, the Fe—Ni alloy having the predetermined composition is melted and cast into a mold to form an ingot. Alternatively, the alloy melt is continuously cast into a slab.

The hot-working includes rough-rolling, hot-forging and hot-rolling. In the case of two heat-processes, for example, the first hot-forging and the subsequent hot-rolling, the above-mentioned heating temperature (T) must be realized in both of the two hot-rolling steps.

The cold-rolling is a step to reduce thickness of the hot-wrought alloy into a sheet for the parts of an electron gun, for example, from 0.05 to 0.5 mm in thickness.

The annealing is a step of heating the cold-rolled sheet to a temperature higher than the recrystallization temperature, for example heating to 600–1050° C.

The present invention is now described with reference to the examples.

EXAMPLES

Twelve kinds of Fe—42%Ni alloys (Nos. 1 through 12) were melted in an induction-type vacuum-melting furnace and cast into a mold to form an approximately 300 kg-ingot. The raw materials were electrolytic iron, electrolytic nickel, electrolytic manganese, metallic titanium, Ni—Mg mother alloy, Ni—Ce mother alloy, Ni—Ca mother alloy and Fe—S (iron sulfide). The iron sulfide was used, when there arose the necessity for adjusting the S content.

The compositions of the alloys are shown in Table 1.

TABLE 1

| Alloy | Chemical Composition (wt %) | | | | | | 19500 8.5-log[% N][% S] | Heating Temperature | Thickness Fraction of Fractured Surface | |
|---|---|---|---|---|---|---|---|---|---|---|
| Nos. | Ni | Mn | S | X | Fe | [% X][% S] | −350 | (° C.) | (%) | Remarks |
| 1 | 41.6 | 0.12 | 0.0018 | Ti: 0.08 | Bal | 0.000144 | 1230 | 1000 | 20.8 | Compartive |
| | | | | | | | | 1200 | 33.3 | Inventive |
| | | | | | | | | 1250 | 26.7 | Comparative |
| 2 | 41.0 | 0.18 | 0.0026 | Mg: 0.05 | Bal | 0.000130 | 1224 | 1000 | 19.6 | Comparative |
| | | | | | | | | 1150 | 32.1 | Inventive |
| | | | | | | | | 1250 | 24.4 | Comparative |
| 3 | 40.8 | 0.34 | 0.0032 | Ce: 0.04 | Bal | 0.000128 | 1223 | 1000 | 21.0 | Comparative |
| | | | | | | | | 1150 | 33.6 | Inventive |
| | | | | | | | | 1250 | 25.3 | Comparative |

TABLE 1-continued

| Alloy | Chemical Composition (wt %) | | | | | | 19500 8.5-log[% N][% S] | Heating Temperature | Thickness Fraction of Fractured Surface | |
|---|---|---|---|---|---|---|---|---|---|---|
| Nos. | Ni | Mn | S | X | Fe | [% X][% S] | −350 | (° C.) | (%) | Remarks |
| 4 | 40.9 | 0.54 | 0.0021 | Ca: 0.03 | Bal | 0.000063 | 1185 | 1000 | 20.3 | Comparative |
| | | | | | | | | 1150 | 32.5 | Inventive |
| | | | | | | | | 1250 | 24.8 | Comparative |
| 5 | 41.7 | 0.08 | 0.0072 | Ti: 0.24 | Bal | 0.001728 | 1381 | 1000 | 21.5 | Comparative |
| | | | | | | | | 1200 | 33.5 | Inventive |
| | | | | | | | | 1300 | 32.8 | Inventive |
| 6 | 40.7 | 0.14 | 0.0086 | Ce: 0.13 | Bal | 0.001118 | 1353 | 1000 | 20.2 | Comparative |
| | | | | | | | | 1200 | 32.9 | Inventive |
| | | | | | | | | 1250 | 32.6 | Inventive |
| 7 | 41.2 | 0.22 | 0.0120 | Ti: 0.18 | Bal | 0.003000 | 1419 | 1000 | 21.2 | Comparative |
| | | | | Ca: 0.07 | | | | 1200 | 33.7 | Inventive |
| | | | | | | | | 1300 | 33.1 | Inventive |
| 8 | 41.4 | 0.07 | 0.0176 | Ti: 0.34 | Bal | 0.007920 | 1489 | 1000 | 19.8 | Comparative |
| | | | | Ca: 0.11 | | | | 1200 | 34.0 | Inventive |
| | | | | | | | | 1300 | 32.6 | Inventive |
| 9 | 41.0 | 0.07 | 0.0012 | Ti: | Bal | 0.000002 | 1031 | 1000 | 19.5 | Comparative |
| | | | | 0.002 | | | | 1200 | 21.2 | Comparative |
| 10 | 41.1 | 0.05 | 0.0015 | Mg: | Bal | 0.000005 | 1058 | 1000 | 20.0 | Comparative |
| | | | | 0.003 | | | | 1200 | 21.3 | Comparative |
| 11 | 40.9 | 0.08 | 0.0016 | Ce: | Bal | 0.000002 | 1014 | 1000 | 19.7 | Comparative |
| | | | | 0.001 | | | | 1200 | 20.9 | Comparative |
| 12 | 41.3 | 0.05 | 0.0013 | Ca: | Bal | 0.000003 | 1034 | 1000 | 19.5 | Comparative |
| | | | | 0.002 | | | | 1200 | 20.6 | Comparative |

Samples 40 mm in size were cut from the respective ingots and were heated to and held for 1 hour at the temperature shown in Table 1. The hot-rolling was started at the heating temperature and continued until the thickness was reduced to 4 mm. The resultant sheets were annealed at 750° C., pickled, and cold-rolled to the thickness of 1.5 mm. The cold-rolled sheets were annealed at 750° C. for 1 hour in vacuum. The so-treated samples were subjected to evaluation of the press-punching formability.

In Remarks of Table 1, the heating temperature falling within and outside the inventive range is denoted as "inventive" and "comparative", respectively. The underlined temperature shown in Table 1 is outside the present invention. The samples were first coined to the thickness of 0.28 mm, and then ten apertures 0.4 mm in diameter were formed. The press-punching formability was evaluated in the press-forming using a 30-ton press machine which pierced ten apertures 0.4 mm in diameter at intervals of 3 mm. The thickness fraction of fractured surface was measured. The thickness fraction of fractured surface is defined by (thickness of fractured cross section/sheet thickness)×100 (%). The thickness of a sheet is the sum of fractured-surface thickness and sheared surface thickness. The thickness fraction of fractured surface shown in Table 1 is the average value of the ten apertures.

The thickness fraction of fractured surface of 30% or more indicates improved press-punching formability, because the burrs become smaller as such fraction becomes greater. Data with 30% or more are shown in FIG. 3 as the ○ marks.

As is clear from Table 1, each of the inventive examples exhibits more than 30% of the fracture-surface area and hence improved press-punching formability. In addition, it is clear that the line expressed by T (° C.)={419500/[8.5−log [%X][%S]]}−350 is the border between the inventive examples with improved press-punching formability and the comparative example.

What is claimed is:

1. A method for producing an Fe—Ni alloy comprising the steps of:

melting an Fe—Ni alloy, which consists essentially of, by weight percentage, from 30 to 55% of Ni, not more than 0.8% of Mn, from 0.001 to 0.050% of S, from 0.005 to less than 0.5% of at least one element selected from the group consisting of Ti, Mg, Ce and Ca, the balance being Fe and unavoidable impurities, and in which the product of the total content of said Ti, Mg, Ce and Ca and the content of S is limited to a range of from 0.00005 to 0.010;

casting the melted alloy;

heating the alloy prior to a hot-working at a temperature (T) under the following equation:

$$1050 \leqq T(^\circ\ \mathrm{C.}) \leqq \{19500/[8.5-\log[\%X][\%S]]\}-350,$$

in which the S content is denoted by [%S], and the content of the total amount of Ti, Mg, Ce and Ca is denoted by [%X], hot-working the heated Fe—Ni alloy;

cold-rolling; and annealing.

2. A method according to claim 1, wherein the S content is from 0.003 to 0.020%.

3. A method according to claim 1, wherein said cold-rolling step comprises reducing thickness of the Fe—Ni alloy to 0.05 to 0.5 mm.

4. A method according to claim 1, wherein said annealing is carried out at a temperature of from 600 to 1050° C.

5. The method according to claim 1, wherein the impurities are selected from the group consisting of C, Si, Al, P and Cr.

6. The method according to claim 1, wherein the impurities are from 0.001 to 0.5% by weight.

7. A method for producing an Fe—Ni alloy comprising the steps of:

melting an Fe—Ni alloy, which consists essentially of, by weight percentage, from 30 to 55% of Ni, not more than 0.8% of Mn, from 0.001 to 0.050% of S, from 0.005 to less than 0.5% of at least one element selected from the group consisting of Ti, Mg, Ce and Ca, the balance being Fe and unavoidable impurities, and in which the product of the total content of said Ti, Mg, Ce and Ca and the content of S is limited to a range of from 0.001 to 0.5%;

casting the melted alloy;

heating the alloy prior to a hot-working at a temperature (T) under the following equation:

$$1050 \leqq T(^\circ\,\mathrm{C.}) \leqq \{19500/[8.5-\log[\%X][\%S]]\}-350,$$

in which the S content is denoted by [%S], and the content of the total amount of Ti, Mg, Ce and Ca is denoted by [%X], hot-working the heated Fe—Ni alloy;

cold-rolling; and annealing.

* * * * *